US011401016B2

(12) United States Patent
Yeo

(10) Patent No.: US 11,401,016 B2
(45) Date of Patent: Aug. 2, 2022

(54) DIVING SUIT WATERPROOF CONNECTOR HAVING LIGHTING DEVICE

(71) Applicant: Un Gyun Yeo, Incheon (KR)

(72) Inventor: Un Gyun Yeo, Incheon (KR)

( * ) Notice: Subject to any disclaimer, the term of this patent is extended or adjusted under 35 U.S.C. 154(b) by 919 days.

(21) Appl. No.: 16/305,047

(22) PCT Filed: May 30, 2017

(86) PCT No.: PCT/KR2017/005603
§ 371 (c)(1),
(2) Date: Nov. 27, 2018

(87) PCT Pub. No.: WO2017/209476
PCT Pub. Date: Dec. 7, 2017

(65) Prior Publication Data

US 2020/0317310 A1 Oct. 8, 2020

(30) Foreign Application Priority Data

May 30, 2016 (KR) ..... 10-2016-0066230

(51) Int. Cl.
*B63C 11/04* (2006.01)
*H05B 47/10* (2020.01)
*B63C 11/02* (2006.01)

(52) U.S. Cl.
CPC ..... *B63C 11/04* (2013.01); *H05B 47/10* (2020.01); *B63C 2011/022* (2013.01); *B63C 2011/043* (2013.01)

(58) Field of Classification Search
CPC ... B63C 11/04; B63C 11/10; B63C 2011/043; B63C 2011/046
USPC ..... 405/185, 186, 187; 2/2.15, 2.17
See application file for complete search history.

(56) References Cited

U.S. PATENT DOCUMENTS 1,099,814 A * 6/1914 Niehoff ..... B63C 11/02 405/187
2,316,101 A * 4/1943 Norred ..... B63C 9/093 285/226
2,593,988 A * 4/1952 Cousteau ..... B63C 11/08 128/201.27
3,364,616 A * 1/1968 Speers ..... A63H 3/52 446/155

(Continued)

FOREIGN PATENT DOCUMENTS

CN 109533234 A * 3/2019 ..... B63C 11/04
GB 109893 A * 10/1917 ..... B63C 11/04

(Continued)

OTHER PUBLICATIONS

International Search Report for PCT/KR2017/005603 dated Sep. 15, 2017 from Korean Intellectual Property Office.

*Primary Examiner* — Frederick L Lagman
(74) *Attorney, Agent, or Firm* — Revolution IP, PLLC

(57) ABSTRACT

A diving suit waterproof connector having a lighting device, includes: a fixing tube part watertightly connected to an end of each of sleeves of the diving suit; and a fastening tube part connected to a neck portion of an underwater work glove, wherein the fixing tube part includes fastening protrusions; a rubber ring press-fitted thereto; and a first contact terminal, and the fastening tube part includes coupling protrusions; a second contact terminal; and a lighting part electrically connected to the second contact terminal.

3 Claims, 5 Drawing Sheets

(56) References Cited

U.S. PATENT DOCUMENTS

| | | | | |
|---|---|---|---|---|
| 7,062,786 | B2 * | 6/2006 | Stinton | B63C 11/04 2/2.15 |
| 2007/0258236 | A1 | 11/2007 | Miller | |
| 2008/0256677 | A1 * | 10/2008 | Loos | A41D 13/0005 2/200.2 |
| 2013/0247267 | A1 * | 9/2013 | Luomala | A41D 13/0005 2/2.17 |
| 2018/0279695 | A1 * | 10/2018 | Axelsson | B63C 11/04 |

FOREIGN PATENT DOCUMENTS

| | | | | |
|---|---|---|---|---|
| GB | 228991 | A | * | 2/1925 |
| JP | 2014-035003 | A | | 2/2014 |
| KR | 820000487 | Y1 | * | 3/1982 |
| KR | 20-1998-0057336 | U | | 10/1998 |
| KR | 10-1999-0083741 | A | | 12/1999 |
| KR | 20-0389272 | Y1 | | 7/2005 |
| KR | 200392356 | Y1 | * | 8/2005 |
| KR | 10-2009-0007769 | A | | 1/2009 |
| KR | 10-2009-0120322 | A | | 11/2009 |

* cited by examiner

[FIG. 1]
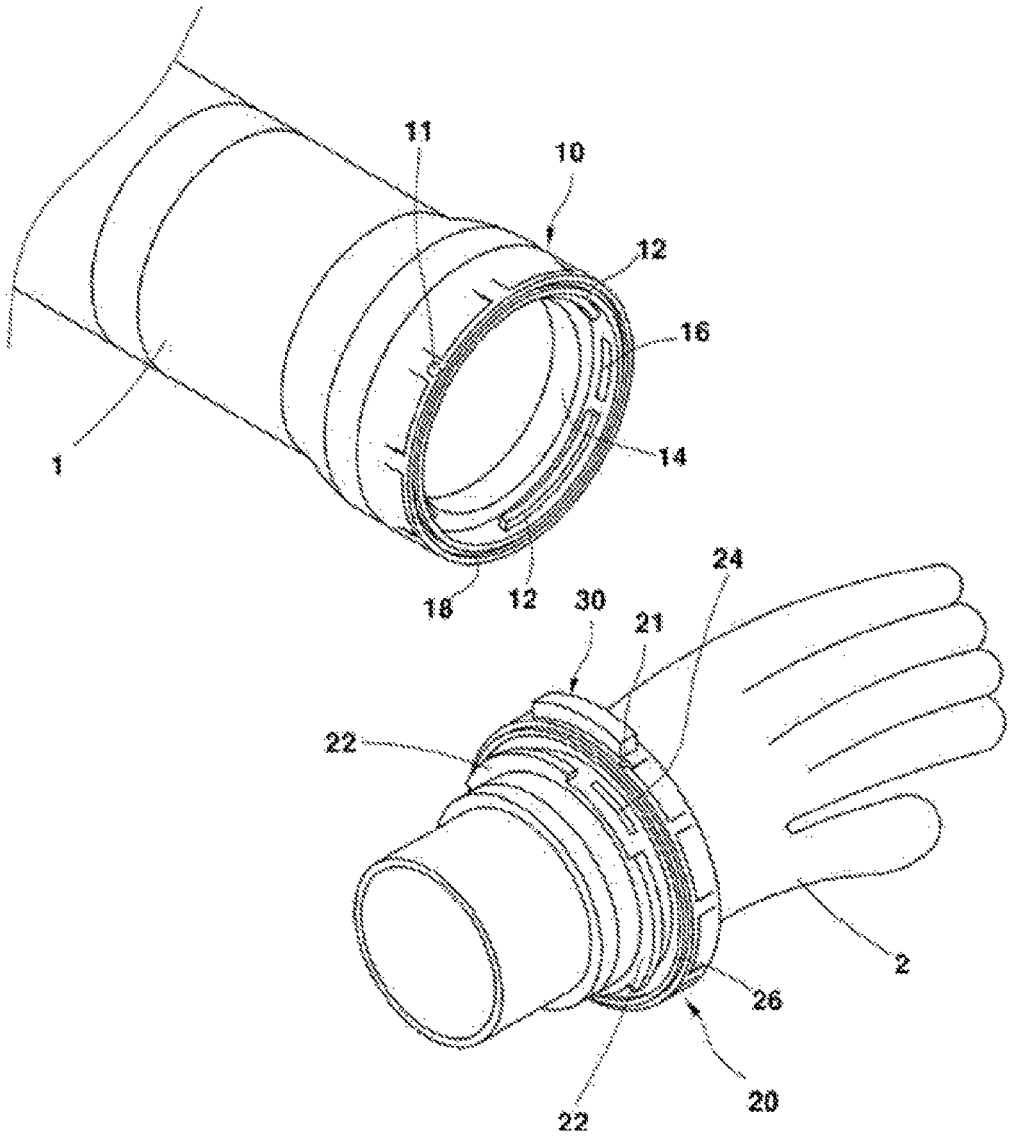

[FIG. 2]
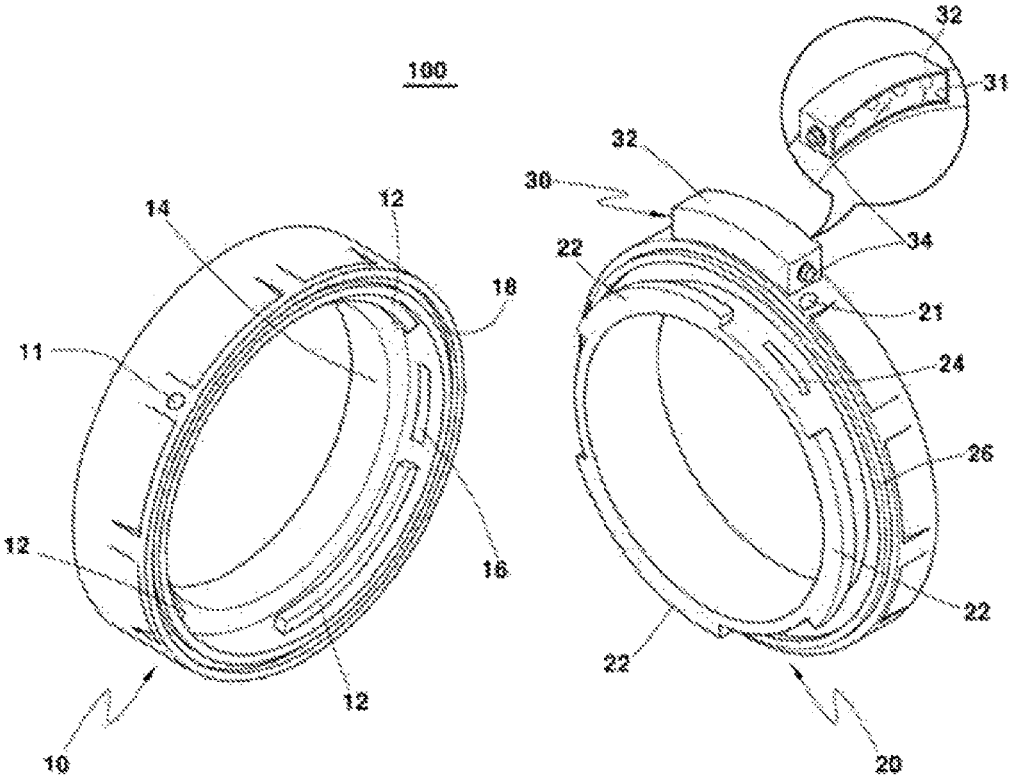

[FIG. 3]
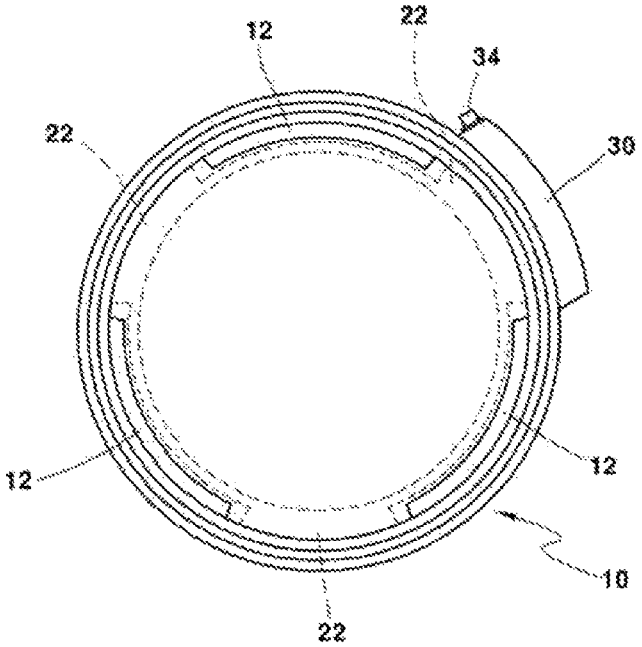
[FIG. 4]
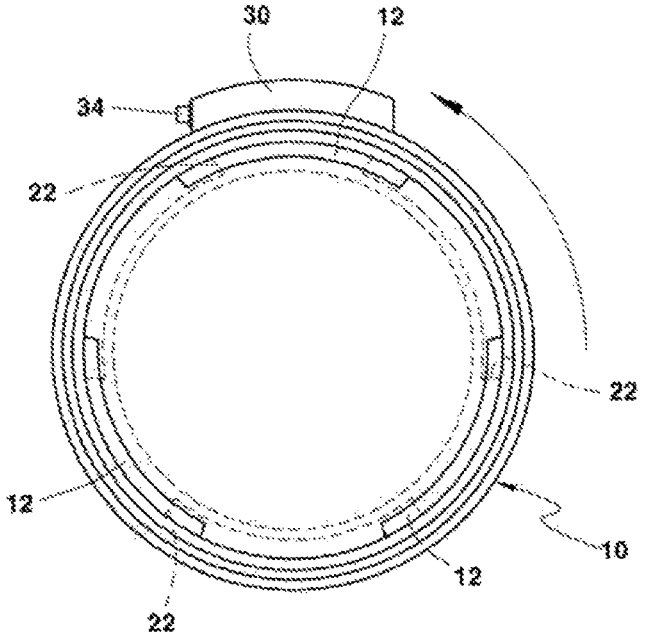

[FIG. 5]
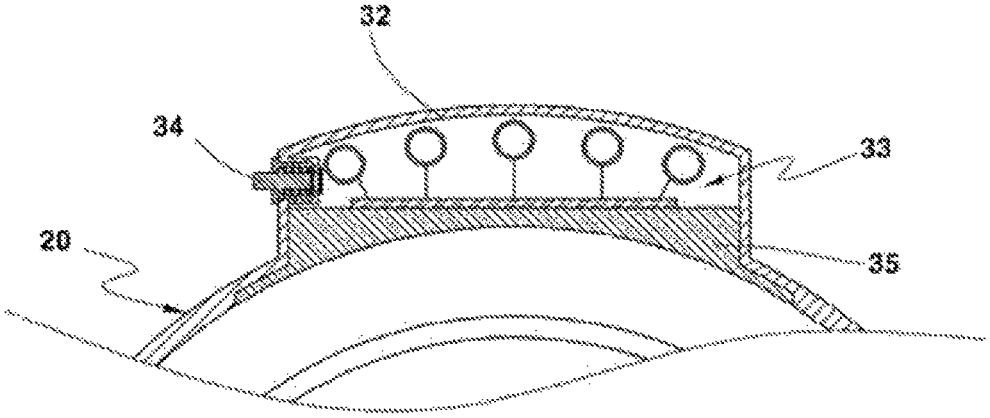

[FIG. 6]
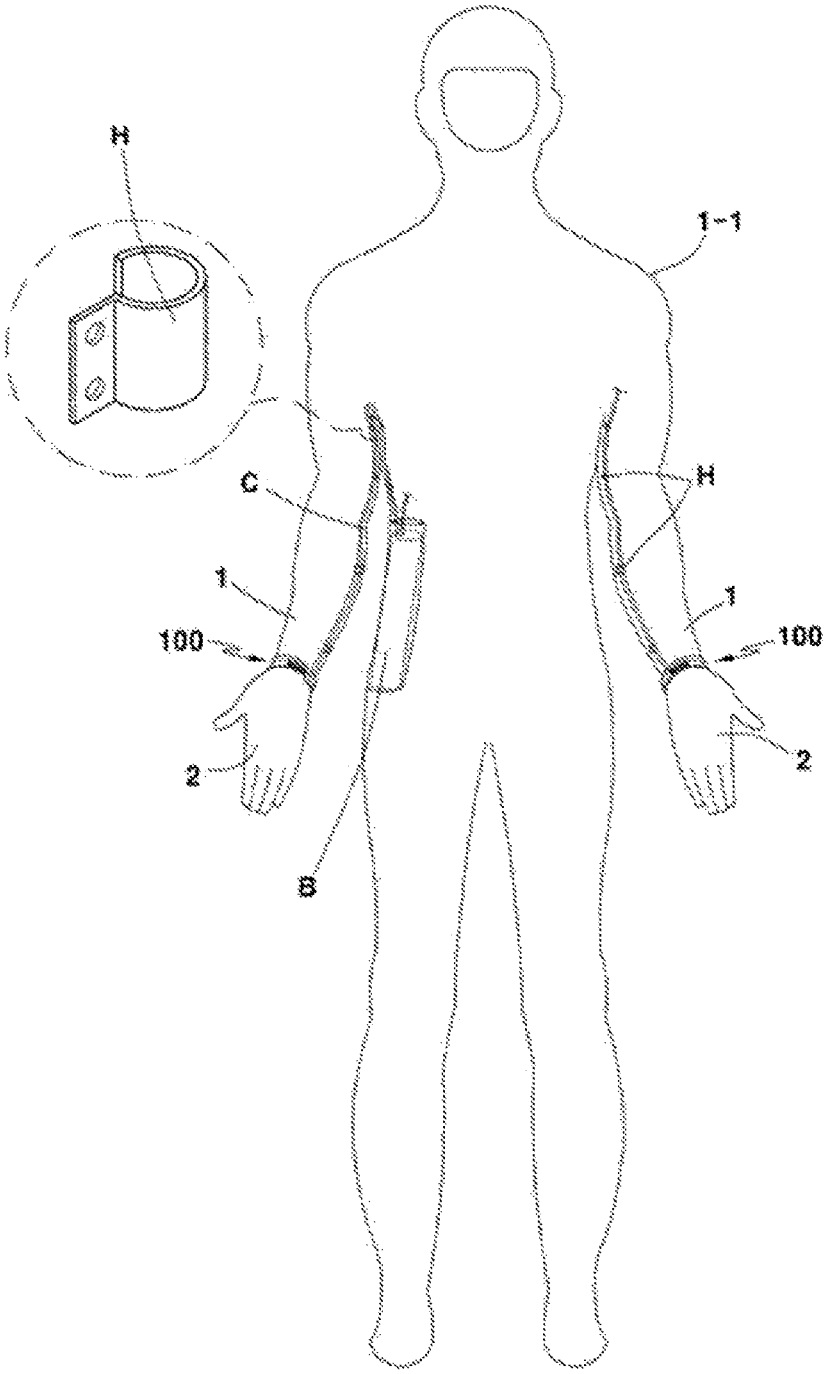

DIVING SUIT WATERPROOF CONNECTOR HAVING LIGHTING DEVICE

TECHNICAL FIELD

The present invention generally relates to a diving suit waterproof connector having a lighting device. More particularly, the present invention relates to a diving suit waterproof connector having a lighting device, wherein the waterproof connector is installed on a sleeve part of a diving suit and connected to an underwater glove, whereby water is prevented from reaching a skin of a wrist part, both hands are freely movable during various underwater operations, and during the operations, a front view is obtained by emitting light in front of a diver via a simple switching manipulation so as to improve workability.

BACKGROUND ART

In general, since during underwater work, a worker is exposed to underwater conditions such as high water pressure, rapid water flow velocity, low water temperature, and malfunction of a watch, many restrictions are placed on working time, working period, and working conditions.

When a worker works in a diving suit under such unfavorable underwater work conditions, frames constituting a frame part of the diving suit resist against high water pressure so that the high water pressure is not applied to the worker, and as for water leakage prevention, the diving suit capable of preventing water leakage completely is made of a head part, a body part, and a lower body part, and is manufactured and used so as to prevent water from entering the diving suit during underwater operations, so that hypothermia due to low water temperature is prevented.

As for the prevention of low temperature, causing the hypothermia, transmitted from an outside of the diving suit, air supplied from an outside by an air supply line is heated and the heated air is supplied into the diving suit, and positions of an inlet opening and an outlet opening are manipulated so as to circulate the heated air in the diving suit, whereby the hypothermia due to low temperature of the outside is prevented.

Accordingly, the diving suit enables activities in atmospheric temperature and pressure as on the ground.

Accordingly, concern for caisson disease is removed and time required to adapt to water and a working site when travelling therebetween is not required, so that work efficiency may be increased.

Underwater operations include disposal of deposited waste, various kinds of underwater fishing, industrial underwater operations, underwater rescue operations, and lighting is necessary in a deep and dark place under water, and gloves for operations are necessary to protect hands.

As a waterproof product developed up to now so as to be used under water, an underwater lantern is being used.

The underwater lantern is disclosed as a conventional art titled "Underwater lantern for diver" in Korean Utility Model Registration No. 20-0389272 (registered on Jun. 30, 2005), which hereinafter is referred to as "patent document".

The underwater lantern of the patent document relates to an underwater lantern for a diver illuminated by power supplied from a vessel and, more particularly, relates to an underwater lantern for a diver, the lantern including a lamp provided therein, a lantern body having a lens cover provided on a front surface of the lamp so as to protect the lamp, and a switch provided on a rear surface of the lantern body, the switch selectively applying a lamp power to an outside of the lantern body of the underwater lantern that has a fixing member provided to be worn on a body of the diver and transmitting signals to the vessel.

However, during the underwater operations, each of divers works with the underwater lantern held in one hand, or they work in pairs when the underwater lantern held by one diver illuminates a working part and the other works in the working part, which causes long working hours.

DISCLOSURE

Technical Problem

Accordingly, the present invention has been made keeping in mind the above problems occurring in the related art, and the present invention is intended to propose a diving suit waterproof connector having a lighting device, wherein the waterproof connector is installed on a sleeve part of a diving suit and connected to an underwater glove, whereby water is prevented from reaching the skin of a wrist part, both hands are freely moveable during various underwater operations, and during the operations, a front view is obtained by emitting light in front of a diver via a simple switching manipulation so as to improve workability.

Technical Solution

In order to achieve the above object, according to one aspect of the present invention, there is provided a diving suit waterproof connector having a lighting device, the waterproof connector including: a fixing tube part 10 watertightly connected to an end of a sleeve 1 of a diving suit 1-1, and a fastening tube part 20 connected to a neck portion of an underwater work glove 2 so as to be attached to/detached from the fixing tube part 10, wherein the fixing tube part 10 includes fastening protrusions 12 provided at equal intervals on an inner circumferential surface of a front end thereof, a rubber ring 14 press-fitted thereto so as to provide elasticity, and a first contact terminal 16 provided on the inner circumferential surface on which each of the fastening protrusions is formed, and the fastening tube part 20 includes coupling protrusions 22 provided at equal intervals on an outer circumferential surface thereof so as to hold and support the fastening protrusions 12 of the fixing tube part 10, a second contact terminal 24, being in contact with the first contact terminal 16, provided on the outer circumferential surface on which each of the coupling protrusions 22 is formed, and a lighting part 30 provided on one side of the fastening tube part and electrically connected to the second contact terminal 24 so as to emit light in front of the underwater work glove, wherein the lighting part includes:

a housing 32 protruding from an outer circumference of the fastening tube part 20 and having a transparent or translucent window 31 at one side of the housing, an LED lighting unit 33 guided into the housing 32 and electrically connected to the second contact terminal 24 so as to emit light to the window, a contact switch 34 provided at one side of the housing so as to turn on and off the LED lighting unit 33, and a sealing material 35 press-fitted to an inner side of the housing 32 so as to protect the LED lighting unit 33, and wherein each of the plurality of fastening protrusions 12 provided at the equal intervals on the inner circumferential surface of the fixing tube part 10 has a circular arc-shaped rod structure along the inner circumferential surface of the fixing tube part 10, the rubber ring 14 of a ring shape is spaced apart from rear ends of the plurality of fastening protrusions 12 at a predetermined interval, each of the plurality of coupling protrusions 22 provided at the equal intervals on the outer circumferential surface of the fastening tube part 20 has a circular arc-shaped rod structure along the outer circumferential surface of the fastening tube part 20, a circular arc length of the coupling protrusion 22 is configured to be shorter than a circular arc length between the fastening protrusions 12 such that the coupling protrusion passes between the fastening protrusions 12, and a width of the coupling protrusion 22 in a forward/rearward direction thereof is configured to be larger than the interval at which the fastening protrusion 12 and the rubber ring 14 are spaced apart from each other, whereby the coupling protrusion 22 of the fastening tube part 20 is guided to be arranged between the fastening protrusions 12 of the fixing tube part 10 and then the fastening tube part 20 is pressed to the fixing tube part 10 and rotated, so that while a front end surface of the coupling protrusion 22 presses the rubber ring 14 of the fixing tube part 10, the coupling protrusion is fastened to the fastening protrusion so as to receive elasticity from the rubber ring 14, and an insertion protrusion 26 of the fastening tube part 20 is guided to a groove 18 of the fixing tube part 10 and combined therewith such that water from the outside is prevented from entering the diving suit 1-1 through the sleeve thereof.

The fixing tube part 10 and the fastening tube part 20 according to the present invention may have display units 11, 21 provided thereon so as to check whether the fastening tube part 20 is completely fastened to the fixing tube part 10.

The first contact terminal 16 of the fixing tube part 10 according to the present invention may be electrically connected to a battery B worn on an inner part of the diving suit by a power cable C, wherein the power cable C may be arranged by fixing clips H fixed on inner parts of the diving suit so as to be connected to and supported by the fixing tube part 10.

Advantageous Effects

The diving suit waterproof connector having a lighting device according to the present invention connects a sleeve part of the diving suit to the underwater glove and during the connection, the coupling protrusions of the fastening tube part are fastened to the fastening protrusions of the fixing tube part in a rotating manner so as to prevent water leakage from the outside, whereby during various underwater operations, a front view is advantageously obtained by the provided lighting part, and the underwater operations can be rapidly completed due to both hands being freely movable.

DESCRIPTION OF DRAWINGS

FIG. 1 is a perspective view showing a diving suit sleeve and a glove to which a waterproof connector of the present invention is applied;

FIG. 2 is a perspective view showing the waterproof connector according to the present invention;

FIGS. 3 and 4 are front views showing fastened states of the waterproof connector according to the present invention;

FIG. 5 is a cross-sectional view showing a lighting part of the waterproof connector according to the present invention; and FIG. 6 is a front view showing connected state of the waterproof connector and a battery according to the present invention.

BEST MODE

Hereinafter, the present invention will be described in detail with reference to the accompanying drawings.

Unless otherwise defined, terms or words used in the specification and claims are not limited to meanings that are commonly understood or are defined in dictionaries, and should be interpreted as having meanings and concepts that are consistent with the context of the present invention, based on the principle that an inventor may properly define concepts of words so as to describe his or her invention in the best mode.

Accordingly, since the preferred embodiment of the present invention and configurations of the drawings have been disclosed for illustrative purposes and do not represent all of the technological spirit of the present invention, those skilled in the art will appreciate that various modifications, additions and substitutions are possible without departing from the scope and spirit of the invention as disclosed in the accompanying claims.

A diving suit waterproof connector having a lighting device 100 according to the present invention is configured as shown in FIGS. 1 and 2.

The diving suit waterproof connector includes a fixing tube part 10 watertightly connected to an end of each of sleeves 1 of a diving suit 1-1, and a fastening tube part 20 connected to a neck portion of each of underwater work gloves 2 so as to be attached to/detached from the fixing tube part 10.

The fixing tube part 10 includes fastening protrusions 12 provided at equal intervals on an inner circumferential surface of a front end thereof, a rubber ring 14 press-fitted thereto so as to provide elasticity, and a first contact terminal 16 provided on the inner circumferential surface on which each of the fastening protrusions is formed.

The fastening tube part 20 includes coupling protrusions 22 provided at equal intervals on an outer circumferential surface thereof so as to hold and support the fastening protrusions 12 of the fixing tube part 10, a second contact terminal 24, being in contact with the first contact terminal 16, provided on the outer circumferential surface on which each of the coupling protrusions 22 is formed, and a lighting part 30 provided on one side of the fastening tube part and electrically connected to the second contact terminal 24 so as to emit light in front of the underwater work glove.

In addition, a groove 18 is provided on one surface of an edge of the fixing tube part 10 connected to the fastening tube part 20, and an insertion protrusion 26 is provided on the fastening tube part 20 so as to be guided by the groove 18 and maintain sealing, whereby sealing is maintained by combination of the groove with the insertion protrusion.

As for fastening the coupling protrusion 22 of the fastening tube part 20 to the fastening protrusion 12 of the fixing tube part 10, when the coupling protrusion 22 is guided to be arranged between the fastening protrusions 12, is pressed and is rotated, a first surface of the coupling protrusion 22 contacts with one surface of the fastening protrusion 12 and a second surface of the coupling protrusion 22 presses the rubber ring 14 such that the coupling protrusion and the fastening protrusion are elastically fastened to each other.

Display units 11, 21 are provided on the fixing tube part 10 and the fastening tube part 20 so as to check whether the fixing tube part and the fastening tube part are completely fastened to each other. Each of the display units 11, 21 may be configured in relief of a protruding shape or in intaglio of a depressed shape and display in a fluorescent paint of a color to be easily checked.

Accordingly, whether the fastening tube part 20 is completely fastened to the fixing tube part 10 may be easily known so that water is prevented from leaking to an inner part of the diving suit 1-1 prior to an underwater operation performed by a diver and so that the contact state of contact terminals of the fixing tube part 10 and the fastening tube part 20, which will be described later, is checked by how much the display units 11, 21 correspond to each other.

The first contact terminal 16 of the fixing tube part 10 is electrically connected to a battery B by a power cable C, the battery being worn on a waist of a diver wearing the diving suit 1-1.

The power cable C is arranged by fixing clips H fixed in the diving suit so as to be connected to and supported by the fixing tube part 10.

Each of the fixing clips H made of soft synthetic resins includes a ring part provided thereon so as to support the power cable at predetermined positions arranged along a longitudinal direction thereof, wherein the ring part includes a fixing piece provided on one side thereof, the fixing piece being fixed in the diving suit and allowing the power cable to be locked in/unlocked from the fixing clip.

Meanwhile, the lighting part 30 provided on the fastening tube part 20 includes a housing 32 protruding from an outer circumference of the fastening tube part 20 and having a transparent or translucent window 31 at one side of the housing, an LED lighting unit 33 guided into the housing 32 and electrically connected to the second contact terminal 24 so as to emit light to the window, a contact switch 34 provided at one side of the housing so as to turn on and off the LED lighting unit 33, and a sealing material 35 press-fitted to an inner side of the housing 32 so as to protect the LED lighting unit 33.

Like a one-touch method, when pushed once, the contact switch 34 including a spring provided therein gives a contact signal and power is on and when the contact switch is pushed once again, power is off.

The sealing material 35, made of soft synthetic resins of the urethane family, is guided from an inner circumferential surface of the fastening tube part to an inner side of the housing so as to be combined therewith, and a lower part of the sealing material is configured in an arc shape corresponding to the inner circumferential surface of the fastening tube part such that interruption is prevented when wearing the glove.

The diving suit waterproof connector having the above-mentioned configuration is installed on each of the sleeves of the diving suit, whereby during underwater operations, a diver can obtain a view to work.

According to the waterproof connector 100, the fastening tube part 20 may be simply attached to/detached from the fixing tube part 10 connected to the sleeve 1 of the diving suit 1-1. Accordingly, as shown in FIGS. 3 and 4, with the diving suit 1-1 and the glove 2 worn on a diver, the coupling protrusion 22 of the fastening tube part 20 is guided to be arranged between the fastening protrusions 12 of the fixing tube part 10, is pressed to the fixing tube part 10, and rotated such that the fastening tube part 20 is fastened to the fixing tube part.

In this case, while the second surface of the coupling protrusion 22 presses the rubber ring 14 of the fixing tube part 10, the coupling protrusion is fastened to the fastening protrusion, the insertion protrusion 26 of the fastening tube part 20 is guided to the groove 18 of the fixing tube part 10 and combined therewith so as to prevent water from entering the diving suit 1-1 from the outside through the sleeve thereof.

When the display units 11, 21 provided on the fixing tube part 10 and the fastening tube part 20 correspond to each other on the same line while the coupling protrusion 22 is in close contact with the fastening protrusion 12, it can be checked that the coupling protrusion and the fastening protrusion are fastened to each other.

As described above, a mutual contact state of the first contact terminal 16 of the fixing tube part 10 and the second contact terminal 24 of the fastening tube part 20 is maintained by the fastened waterproof connector 100, and when the contact switch 34 of the lighting part 30 is pushed once and electrically turned on, multiple LEDs in the LED lighting unit 33 are turned on.

The contact switch 34 is manipulated in cooperation with the battery B worn on the waist of a diver in the diving suit 1-1 and the power cable C connected thereto so as to turn on and off the lighting part 30 on each glove of the pair of gloves.

That is, as described above, with the gloves 2 worn on both hands, a diver turns on the LED lighting unit 33 provided in the housing 32 of the lighting part 30, and the LED lighting unit turned on emits light in front of the diver through the window 31 of the housing 32, so that a front view of the diver can be advantageously obtained during various underwater operations.

Accordingly, since a diver moves freely in that the diver can use both hands, the diver can easily perform underwater operations, compared to a conventional method operated with an underwater lantern held in one hand.

In the above-mentioned regard, an efficient operation under water decreases bottom time, thereby decreasing a factor such as caisson disease to the maximum and maintaining a normal body temperature due to the waterproof connector 100 connecting the glove 2 to the sleeve 1 of the diving suit 1-1.

On the ground, when the coupling protrusion is released from the fastening protrusion by rotating the fastening tube part with a twisting motion relative to the fixing tube part, the first contact terminal and the second contact terminal are short-circuited and power is not supplied to the lighting part any longer.

Accordingly, for underwater operations, a diver is required to wear the glove in that a diver can use the lighting part only when the fastening tube part including the glove is fastened to the fixing tube part. Accordingly, the present invention may prevent the possibility that the diver does not wear the glove, thereby protecting hands of the diver, enabling safe underwater operations, and preventing hypothermia.

As described above, though the present invention is described by certain things such as specific components, a limited embodiment, and the drawings, they are provided just for general understanding of the present invention, but the present invention is not limited to the embodiment, and those skilled in the art will appreciate that various modifications, additions and substitutions are possible, without departing from the scope and spirit of the invention as disclosed in the accompanying claims.

Accordingly, the spirit of the present invention should not be limited to the embodiment disclosed for illustrative purposes, and those skilled in the art will appreciate that various modifications on the same level with or equivalent to the scope of the invention as disclosed in the accompanying claims belong to the spirit and scope of the present invention.

The invention claimed is:

1. A diving suit waterproof connector having a lighting device, the waterproof connector comprising:

a fixing tube part (10) watertightly connected to an end of a sleeve (1) of a diving suit (1-1), and a fastening tube part (20) connected to a neck portion of an underwater work glove (2) so as to be attached to/detached from the fixing tube part (10), wherein the fixing tube part (10) includes fastening protrusions (12) provided at equal intervals on an inner circumferential surface of a front end thereof, a rubber ring (14) press-fitted thereto so as to provide elasticity, and a first contact terminal (16) provided on the inner circumferential surface on which each of the fastening protrusions is formed, and the fastening tube part (20) includes coupling protrusions (22) provided at equal intervals on an outer circumferential surface thereof so as to hold and support the fastening protrusions (12) of the fixing tube part (10), a second contact terminal (24), being in contact with the first contact terminal (16), provided on the outer circumferential surface on which each of the coupling protrusions (22) is formed, and a lighting part (30) provided on one side of the fastening tube part and electrically connected to the second contact terminal (24) so as to emit light in front of the underwater work glove, wherein the lighting part includes:

a housing (32) protruding from an outer circumference of the fastening tube part (20) and having a transparent or translucent window (31) at one side of the housing, an LED lighting unit (33) guided into the housing (32) and electrically connected to the second contact terminal (24) so as to emit light to the window, a contact switch (34) provided at one side of the housing so as to turn on and off the LED lighting unit (33), and a sealing material (35) press-fitted to an inner side of the housing (32) so as to protect the LED lighting unit (33), and wherein each of the plurality of fastening protrusions (12) provided at the equal intervals on the inner circumferential surface of the fixing tube part (10) has a circular arc-shaped rod structure along the inner circumferential surface of the fixing tube part (10), the rubber ring (14) of a ring shape is spaced apart from rear ends of the plurality of fastening protrusions (12) at a predetermined interval, each of the plurality of coupling protrusions (22) provided at the equal intervals on the outer circumferential surface of the fastening tube part (20) has a circular arc-shaped rod structure along the outer circumferential surface of the fastening tube part (20), a circular arc length of the coupling protrusion (22) is configured to be shorter than a circular arc length between the fastening protrusions (12) such that the coupling protrusion passes between the fastening protrusions (12), and a width of the coupling protrusion (22) in a forward/rearward direction thereof is configured to be larger than the interval at which the fastening protrusion (12) and the rubber ring (14) are spaced apart from each other, whereby the coupling protrusion (22) of the fastening tube part (20) is guided to be arranged between the fastening protrusions (12) of the fixing tube part (10) and then the fastening tube part (20) is pressed to the fixing tube part (10) and rotated, so that while a front end surface of the coupling protrusion (22) presses the rubber ring (14) of the fixing tube part (10), the coupling protrusion is fastened to the fastening protrusion so as to receive elasticity from the rubber ring (14), and an insertion protrusion (26) of the fastening tube part (20) is guided to a groove (18) of the fixing tube part (10) and combined therewith such that water from the outside is prevented from entering the diving suit (1-1) through the sleeve thereof.

2. The waterproof connector of claim 1, wherein the fixing tube part (10) and the fastening tube part (20) have display units (11, 21) provided thereon so as to check whether the fastening tube part (20) is completely fastened to the fixing tube part (10).

3. The waterproof connector of claim 1, wherein the first contact terminal (16) of the fixing tube part (10) is electrically connected to a battery (B) worn on an inner part of the diving suit by a power cable (C), wherein the power cable (C) is arranged by fixing clips (H) fixed on inner parts of the diving suit so as to be connected to and supported by the fixing tube part (10).

* * * * *